US009869265B2

(12) United States Patent
Kim et al.

(10) Patent No.: US 9,869,265 B2
(45) Date of Patent: Jan. 16, 2018

(54) CONTROL METHOD FOR HEATED INJECTOR SYSTEM OF A VEHICLE

(71) Applicants: HYUNDAI MOTOR COMPANY, Seoul (KR); KIA MOTORS CORPORATION, Seoul (KR)

(72) Inventors: Hyun Kim, Hwaseong-si (KR); Ho Young Lee, Yongin-si (KR)

(73) Assignees: HYUNDAI MOTOR COMPANY, Seoul (KR); KIA MOTORS CORPORATION, Seoul (KR)

( * ) Notice: Subject to any disclaimer, the term of this patent is extended or adjusted under 35 U.S.C. 154(b) by 47 days.

(21) Appl. No.: 14/834,206

(22) Filed: Aug. 24, 2015

(65) Prior Publication Data

US 2016/0160789 A1 Jun. 9, 2016

(30) Foreign Application Priority Data

Dec. 9, 2014 (KR) ..... 10-2014-0176057

(51) Int. Cl.

| | |
|---|---|
| ***F02D 41/00*** | (2006.01) |
| ***F02D 41/30*** | (2006.01) |
| ***F02M 53/06*** | (2006.01) |
| ***F02D 41/06*** | (2006.01) |

(52) U.S. Cl.

CPC ..... *F02D 41/3005* (2013.01); *F02D 41/0025* (2013.01); *F02D 41/064* (2013.01); *F02D 41/3082* (2013.01); *F02M 53/06* (2013.01); *F02D 2200/021* (2013.01); *F02D 2200/0414* (2013.01); *F02D 2200/0602* (2013.01)

(58) Field of Classification Search

CPC ..... F02D 2200/0602; F02D 2200/021; F02D 2200/0414; F02D 41/064; F02M 53/06

See application file for complete search history.

(56) References Cited

U.S. PATENT DOCUMENTS

| | | | | |
|---|---|---|---|---|
| 3,989,019 | A * | 11/1976 | Brandt | F02M 31/16 123/552 |
| 4,870,932 | A * | 10/1989 | Asmus | F02M 31/125 123/179.15 |
| 6,209,500 | B1 * | 4/2001 | Tallio | F02N 19/02 123/179.21 |
| 6,332,457 | B1 * | 12/2001 | Imoehl | F02M 53/06 123/179.21 |
| 6,626,162 | B2 * | 9/2003 | Shelor | F02D 33/003 123/541 |

(Continued)

FOREIGN PATENT DOCUMENTS

| | | |
|---|---|---|
| JP | 2004-340028 A | 12/2004 |
| JP | 2012-031754 A | 2/2012 |

(Continued)

*Primary Examiner* — Hieu T Vo
*Assistant Examiner* — Sherman Manley
(74) *Attorney, Agent, or Firm* — McDermott Will & Emery LLP

(57) ABSTRACT

A control method of the heated injector system for a vehicle including an injector, injecting fuel into an engine of the vehicle, and a fuel pump supplying the fuel to the injector, includes activating a heater to preheat the injector, stopping fuel supply by stopping driving of the fuel pump, and upon stopping the fuel supply, re-activating the heater to heat the injector.

5 Claims, 4 Drawing Sheets

(56) References Cited

U.S. PATENT DOCUMENTS

| | | | | |
|---|---|---|---|---|
| 6,839,508 | B2 * | 1/2005 | Biess | F02M 31/125 123/549 |
| 2002/0005178 | A1 * | 1/2002 | Iwatani | F01M 5/021 123/41.14 |
| 2005/0263136 | A1 * | 12/2005 | Rigney | F02M 31/135 123/470 |
| 2008/0127918 | A1 * | 6/2008 | Wineland | F02M 53/06 123/90.11 |
| 2008/0127940 | A1 * | 6/2008 | Stephan | F02M 53/06 123/445 |
| 2008/0127951 | A1 * | 6/2008 | Gale | F02D 41/20 123/549 |
| 2010/0139628 | A1 * | 6/2010 | Pursifull | F02M 31/125 123/557 |
| 2013/0275025 | A1 * | 10/2013 | Isenberg | F02M 53/06 701/103 |
| 2014/0172274 | A1 * | 6/2014 | Douglas | F02D 41/3076 701/104 |
| 2015/0122217 | A1 * | 5/2015 | Bullmer | F02M 53/02 123/295 |

FOREIGN PATENT DOCUMENTS

| | | | |
|---|---|---|---|
| KR | 10-2001-0098186 | A | 11/2001 |
| KR | 10-2005-0108763 | A | 11/2005 |
| KR | 10-2014-0078424 | A | 6/2014 |

* cited by examiner

CONTROL METHOD FOR HEATED INJECTOR SYSTEM OF A VEHICLE

CROSS-REFERENCE TO RELATED APPLICATION

This application is based on and claims the benefit of priority to Korean Patent Application No. 10-2014-0176057, filed on Dec. 9, 2014 in the Korean Intellectual Property Office, the disclosure of which is incorporated herein in its entirety by reference.

TECHNICAL FIELD

The present disclosure relates to a control method for a heated injector system of a vehicle, and more particularly, to a control method for a heated injector system of a vehicle capable of optimizing heating control for improvement of heating performance.

BACKGROUND

In the case of an engine using gasoline, ethanol, and the like, as fuel, one of the most important factors for improving performance and fuel economy and decreasing exhaust gas is to improve combustion characteristics. A combustion process of a general spark ignition engine is a diffusion flame type process in which flame is expanded from an ignition source when the fuel is mixed with air and the fuel-air mixture is ignited by spark plug as illustrated in the following drawings.

In order to improve combustion characteristics in pre-mixed combustion, the particle size of the fuel should be small and the fuel should be easily vaporized and easily mixed with air. To this end, technologies for improving spray characteristics of the injector and flow characteristics in the combustion chamber have been actively developed and applied. Combustion characteristics at a low temperature generally deteriorate due to deterioration of vaporization characteristic of the fuel. Therefore, in order to improve start-up performance at the time of cold start, the amount of the fuel is increased, power generation of an alternator is prohibited, and multi-ignition, or the like, is applied, thereby improving start-up performance.

Therefore, in order to improve the combustion characteristics at a low temperature, there is a need to improve start-up performance by optimizing heating control in the system to which a heated injector for increasing the temperature of the fuel is applied.

SUMMARY

The present disclosure has been made to solve the above-mentioned problems occurring in the prior art while advantages achieved by the prior art are maintained intact.

An aspect of the present disclosure provides a control method for a heated injector system for a vehicle capable of optimizing heating control for a heated injector to improve start-up performance in order to improve combustion characteristics at a low temperature.

The technical objects of the present disclosure are not limited to the above-mentioned technical objects, and other technical objects that are not mentioned will be clearly understood by those skilled in the art through the following descriptions.

According to an exemplary embodiment of the present disclosure, a control method for the heated injector system for a vehicle including an injector, injecting fuel into an engine of the vehicle, and a fuel pump supplying the fuel to the injector, includes activating a heater to preheat the injector, stopping fuel supply by stopping driving of the fuel pump, and upon stopping the fuel supply, re-activating the heater to heat the injector.

Details of embodiments will be described below with reference to the accompanying drawings.

BRIEF DESCRIPTION OF THE DRAWINGS

The above and other objects, features and advantages of the present disclosure will be more apparent from the following detailed description taken in conjunction with the accompanying drawings.

DETAILED DESCRIPTION

Figure 1:
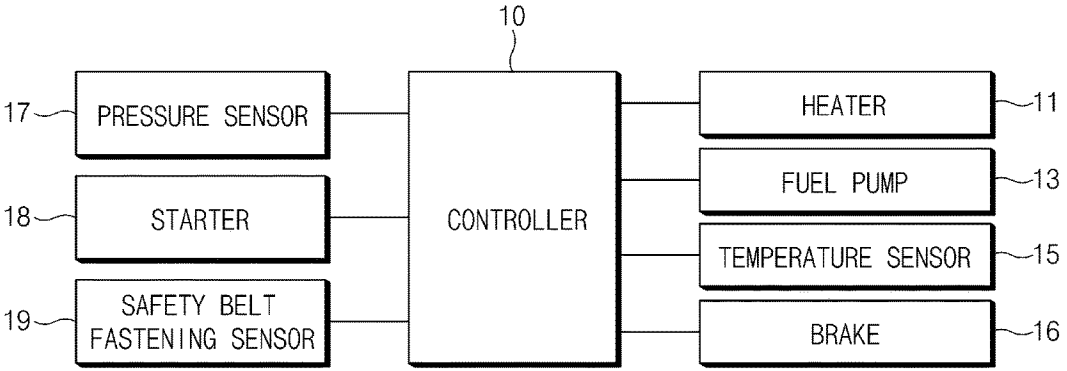
FIG. 1 is a block diagram of a control method for a heated injector system for a vehicle according to an exemplary embodiment of the present disclosure.

Advantages and features of the present disclosure and methods to achieve them will be elucidated from exemplary embodiments described below in detail with reference to the accompanying drawings.

However, the present disclosure is not limited to the exemplary embodiment disclosed herein but will be implemented in various forms. The exemplary embodiments make the present disclosure thorough and are provided so that those skilled in the art can easily understand the scope of the present disclosure. Therefore, the present disclosure will be defined by the scope of the appended claims. Like reference numerals throughout the description denote like elements.

Hereinafter, a control method for a heated injector system for a vehicle according to exemplary embodiments of the present disclosure will be described with reference to the accompanying drawings.

There is a separate gasoline auxiliary fuel tank in a vehicle which uses gasoline for start-up at a low temperature in the vehicle engine. A heated injector system is a system of heating an injector supplied with fuel to increase temperature of the fuel in order to improve start-up performance at a low temperature. Referring to FIG. 1, in the heated injector system, a heater 11 is embedded in the injector, and activating or re-activating of the heater 11 is controlled by a controller 10, such that the temperature of the fuel is increased to a level at which combustion may be performed.

Figure 2:
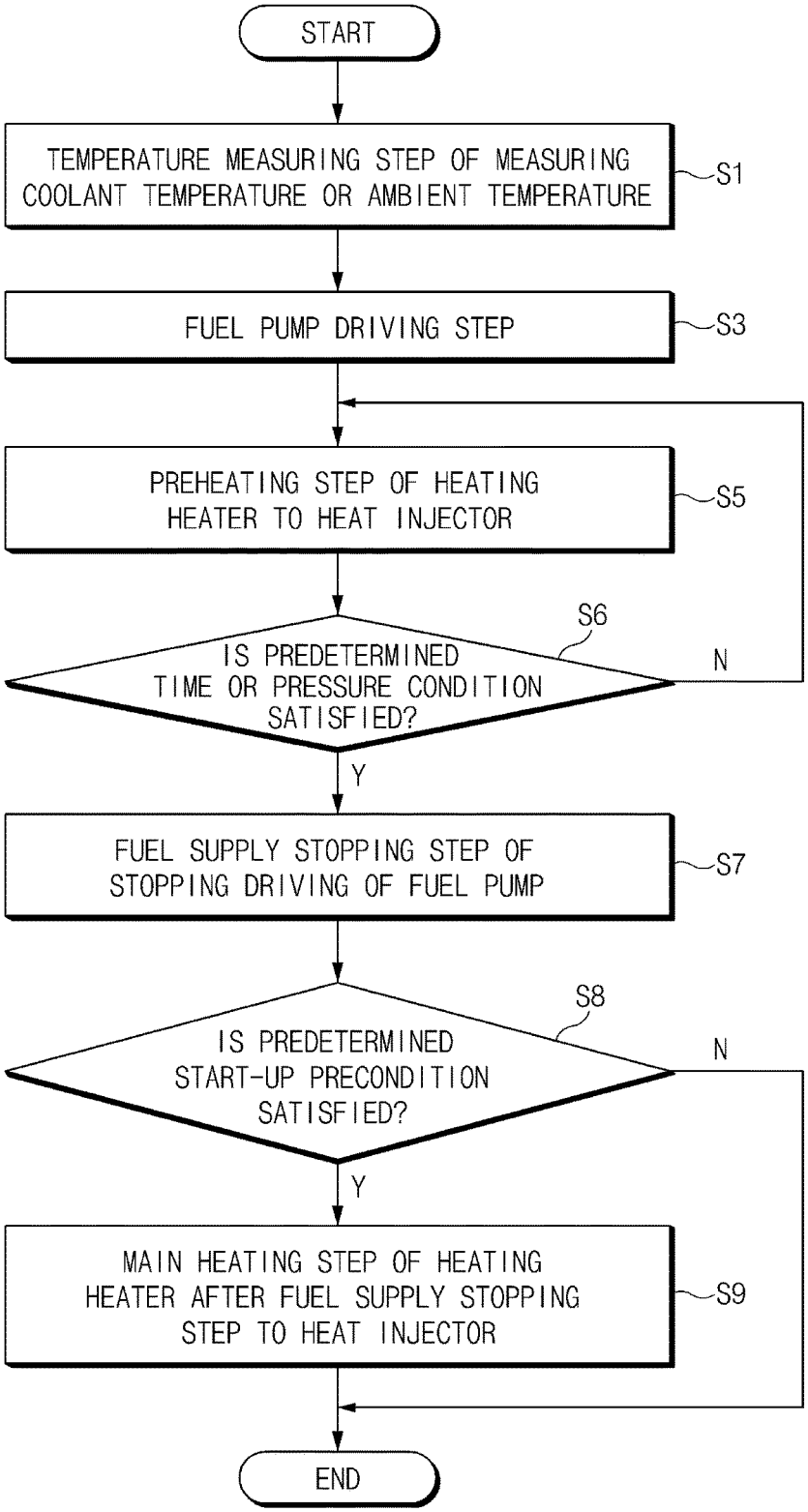
FIG. 2 is a flow chart of a control method for a heated injector system for a vehicle according to an exemplary embodiment of the present disclosure.

A control method for a heated injector system for a vehicle includes an injector injecting the fuel into an engine and a fuel pump 13 supplying the fuel to the injector according to an exemplary embodiment of the present disclosure. Referring to FIG. 2, the control method for a heated injector system for a vehicle includes a preheating step S5 of activating the heater 11 to preheat the injector. The method also includes a fuel supply stopping step S7 in which driving of the fuel pump 13 is stopped. The method also includes a main heating step S9 in which the heater 11 is re-activated after the fuel supply stopping step S7 to heat the injector. The preheating step S5 is performed prior to the main heating step S9. The controller 10 performs the preheating step S5 prior to the main heating step S9. Therefore, according to the present disclosure, an additional heating step is further included as compared to the related art.

The control method for a heated injector system for a vehicle according to the exemplary embodiment of the present disclosure further includes a fuel pump driving step S3 performed simultaneously with or in advance prior to the preheating step S5.

The controller 10 may perform the preheating step S5 after the fuel pump driving step S3. The controller 10 may perform the fuel pump driving step S3 and the preheating step S5, simultaneously.

The preheating step S5 and the fuel pump driving step S3 are terminated when a predetermined operation time elapses.

The controller 10 performs the preheating step S5 and the fuel pump driving step S3 for the predetermined time (for example, 1 to 3 seconds).

The preheating step S5 and the fuel pump driving step S3 are terminated when pressure of the fuel satisfies a predetermined pressure. The controller 10 is connected to a pressure sensor 17. The pressure sensor 17 senses the pressure of the fuel introduced in the injector.

When the pressure of the fuel reaches a predetermined pressure, the controller 10 determines that the fuel is completely filled in the injector. Therefore, the controller 10 determines that there is no need to drive the fuel pump 13 any longer, such that the fuel supply stopping step S7 is performed to stop the driving of the fuel pump 13.

A duration time of the preheating step S5 is determined so as to be longer than that of the fuel pump driving step S3. The controller 10 may adjust a heating time depending on an ambient temperature. Therefore, even after the fuel is completely filled in the injector, the preheating step S5 may be continued.

The control method of the heated injector system for a vehicle according to the exemplary embodiment of the present disclosure further includes, prior to the preheating step S3, a temperature measuring step S1 is performed for measuring the coolant temperature or the ambient temperature. A temperature sensor 15 measures the coolant temperature or ambient temperature. The temperature sensor 15 transfers the measurement value to the controller 10. The controller 10 determines the ambient temperature through the measurement value provided by the temperature sensor 15.

The preheating step S5 and the main heating step S9 can be performed when the temperature measured in the temperature measuring step S1 is equal to or less than a predetermined temperature. The controller 10 determines a necessity for the preheating step S5 and the main heating step S9 based on the ambient temperature.

The control method of the heated injector system for a vehicle according to the exemplary embodiment of the present disclosure further includes a cranking prediction step S8, after the fuel supply stopping step S7 and prior to the main heating step S9. The cranking predicting step S8 is a step for predicting whether or not a driver has an intention to operate the engine. The controller 10 determines whether or not there is a need to perform the main heating step S9 through the cranking predicting step S8 after the fuel supply stopping step S7.

The cranking predicting step S8 is to predict an intention of the driver to start-up the engine based on a predetermined start-up precondition, and the main heating step S9 is performed when the predetermined start-up precondition in the cranking predicting step S8 is satisfied.

Figure 3:
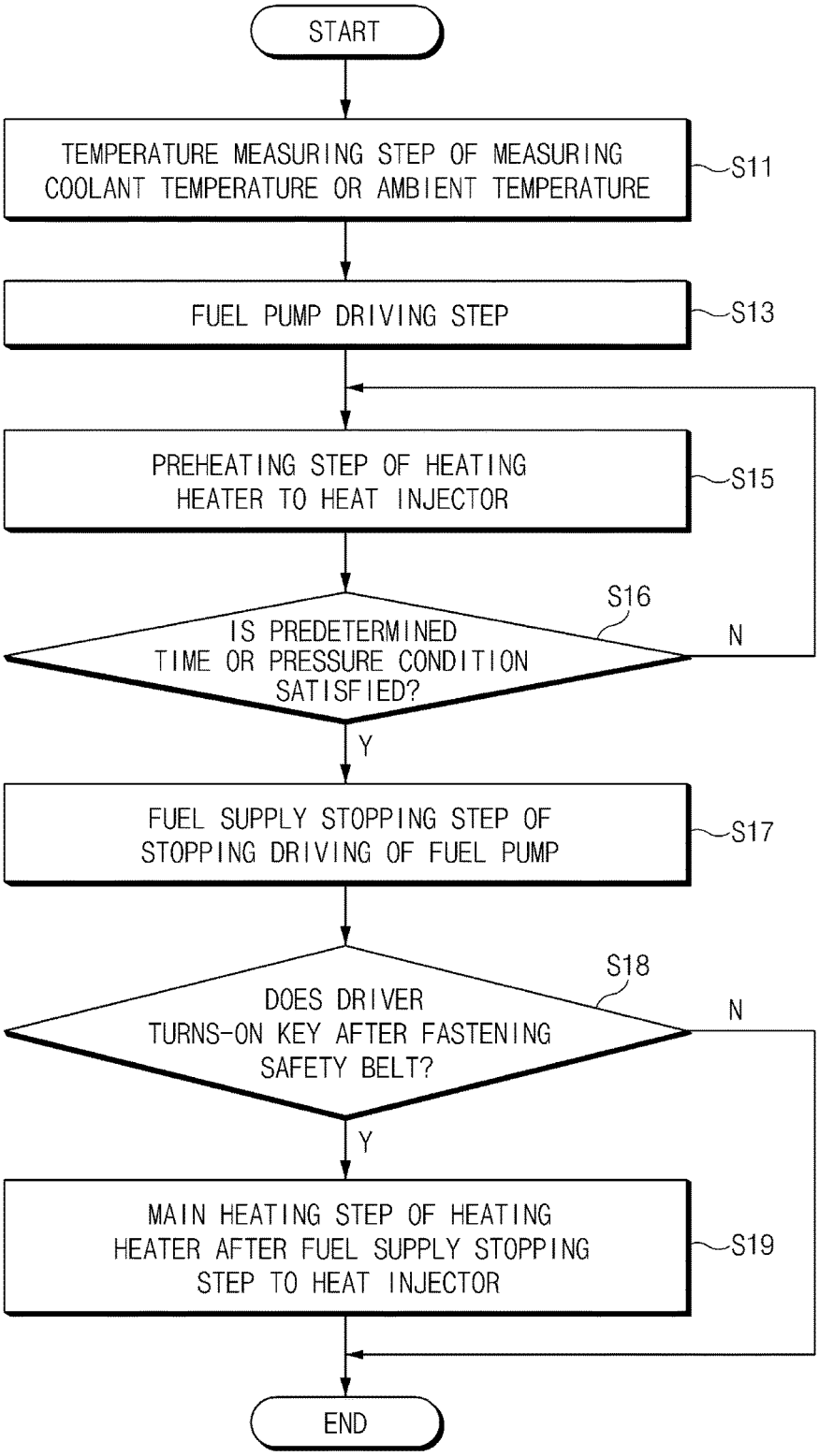
FIG. 3 is a flow chart of the control method for a heated injector system for a vehicle including an example of a cranking predicting step of FIG. 2.

According to another exemplary embodiment of the present disclosure, the start-up precondition may include that the driver turns-on a key (e.g., ignition key) after fastening a safety belt (shown as S18 in FIG. 3). In the cranking predicting step S8, the controller 10 can sense whether the start-up precondition is satisfied. The controller 10 receives a signal form a starter 18. The starter 18 transfers a signal indicating insertion of the key, a degree of rotation of the key, or pressing of the key, or the like, to the controller 10.

Figure 4:
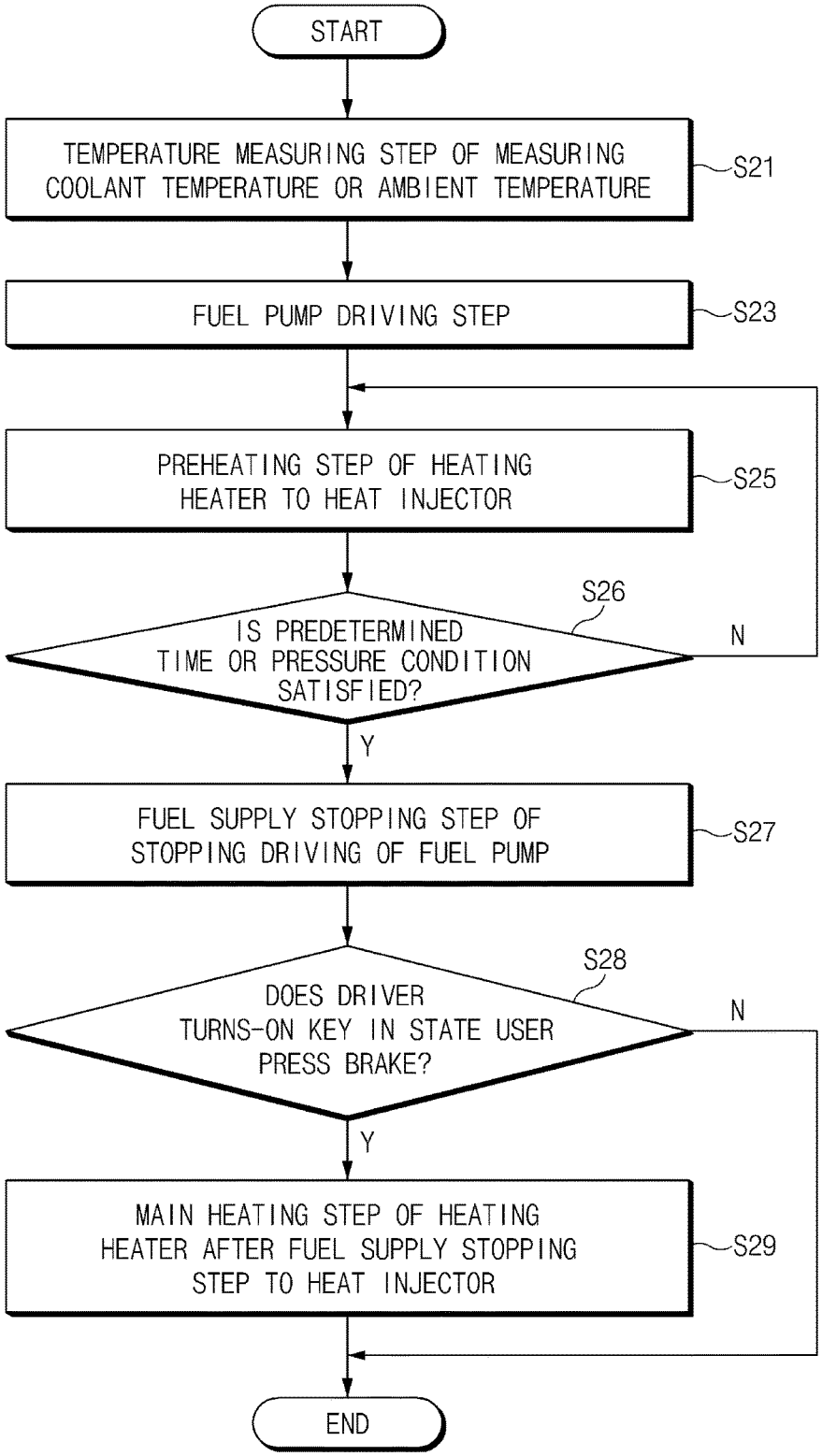
FIG. 4 is a flow chart of the control method for a heated injector system for a vehicle including another example of the cranking predicting step of FIG. 2.

Alternatively, according to yet another exemplary embodiment of the present disclosure, the start-up precondition may include that the driver turns-on a key in a state in which the driver presses the brake (shown as step S28 in FIG. 4). The controller 10 may also receive a signal form a safety belt fastening sensor 19. In the case in which the driver presses the brake 16, the controller 10 may predict that start-up for driving will be requested soon. The controller 10 may determine that in the case in which the driver fastens the safety belt, the driver will drive the vehicle, such that it may be predicted that the cranking operation will be requested. The controller 10 may be connected to the safety belt fastening sensor 19 to sense whether or not the driver fastens the safety belt.

With the control method for a heated injector system for a vehicle according to the exemplary embodiments of the present disclosure as described above, a heating point in time and a heating time may be efficiently controlled. The fuel to be required in the engine may be supplied and the temperature of the fuel may be increased at the same time by performing an injector heating control simultaneously with driving the fuel pump 13 for improving start-up performance. Therefore, the most effective control for improving start-up performance may be performed.

That is, a heating time at the time of cranking, which is a start-up waiting time for start-up, may be decreased, thereby start-up performance may be effectively improved.

As described above, according to the exemplary embodiment of the present invention, the following advantages may be provided.

First, start-up performance and marketability of the vehicle may be improved.

Second, an effective preheating control may be performed by performing the control in interlock with a fuel pump control logic.

Third, exhaust gas may be decreased by decreasing the start-up time and optimally performing the heating control.

The effects of the present invention are not limited to the above-mentioned effects, and other effects that are not mentioned will be clearly understood by those skilled in the art through the accompanying claims.

Although the preferred embodiments of the present disclosure have been disclosed for illustrative purposes, the present disclosure is not limited to the above-mentioned exemplary embodiments, but those skilled in the art will appreciate that various modifications, additions and substitutions are possible, without departing from the scope and spirit of the disclosure as disclosed in the accompanying claims. Accordingly, such modifications, additions and substitutions should also be understood to fall within the scope of the present disclosure.

What is claimed is:

1. A control method for a heated injector system for a vehicle having an injector, injecting fuel into an engine of the vehicle, and a fuel pump supplying the fuel to the injector, the method comprising steps of:

(a) measuring a coolant temperature or an ambient temperature of the vehicle;

(b) driving the fuel pump for a first predetermined operation time;

(c) activating a heater in the injector to preheat the injector for a second predetermined operation time that is determined depending on the coolant temperature or the ambient temperature;

(d) stopping fuel supply by stopping driving of the fuel pump when the first predetermined operation time elapses;

(e) stopping the heater when the second predetermined operation time elapses;

(f) after the step (e), predicting an intention of a driver to start-up the engine of the vehicle based on a predetermined start-up precondition; and (g) re-activating the heater in the injector to heat the injector when the predetermined start-up precondition is satisfied.

2. The control method according to claim 1, wherein the first predetermined operation time and the second predetermined operation time are predetermined to perform the step (e) simultaneously with or after the step (d).

3. The control method according to claim 1, wherein the step (c) and the step (g) are performed when the measured coolant temperature or the ambient temperature is equal to or less than a predetermined temperature.

4. The control method according to claim 1, wherein the predetermined start-up precondition includes turning of a key after fastening a safety belt.

5. The control method according to claim 1, wherein the predetermined start-up precondition includes turning of a key in a state in which a brake is being pressed.

* * * * *